United States Patent [19]

Berger et al.

[11] Patent Number: 4,485,571

[45] Date of Patent: Dec. 4, 1984

[54] HOT AIR RECOVERY SYSTEM FOR A LAUNDRY MANGLE

[75] Inventors: Johannes Berger; Wolfgang Blechschmidt; Christian Wolff, all of Karl-Marx-Stadt, German Democratic Rep.

[73] Assignee: Veb Kombinat Textima, Karl-Marx-Stadt, German Democratic Rep.

[21] Appl. No.: 448,454

[22] Filed: Nov. 8, 1982

[30] Foreign Application Priority Data

Nov. 27, 1981 [DD] German Democratic Rep. ... 235194

[51] Int. Cl.[3] ..... D06F 67/08

[52] U.S. Cl. ..... 38/14; 38/44

[58] Field of Search ..... 38/3, 14, 44, 48, 54; 34/86, 114, 119

[56] References Cited

U.S. PATENT DOCUMENTS 3,197,896 8/1965 Fleissner ..... 38/14

FOREIGN PATENT DOCUMENTS 131918 10/1901 Fed. Rep. of Germany .
468074 11/1928 Fed. Rep. of Germany .
2814618 1/1980 Fed. Rep. of Germany .
3006077 8/1981 German Democratic Rep. .... 38/48

*Primary Examiner*—Werner H. Schroeder
*Assistant Examiner*—Andrew M. Falik
*Attorney, Agent, or Firm*—Jordan and Hamburg

[57] ABSTRACT

A heated trough mangle comprises a frame, at least one mangle unit situated inside the frame and including a mangle cylinder with a perforated mangle surface and at least one heated mangle trough partially surrounding the mangle cylinder, an exhaust device with an exhaust air channel to withdraw exhaust air from inside the mangle cylinder to outside through the exhaust air channel, an air supply device to supply fresh air and having an air providing device, and an apparatus to transfer heat from one air stream to another air stream. The improvement comprises a heat exchanger with first and second flow chambers situated in each mangle unit, the first flow chamber of the heat exchanger being connected at one end to the mangle cylinder and connected at the other end to the exhaust device through the exhaust air channel, the second flow chamber being connected to the air supply device and forming a continuous fresh air supply channel. The air providing device of the air supply device terminates adjacent to the mangle cylinder so that the fresh air is continuously heated and supplied to the mangle unit to dry laundry pieces.

8 Claims, 2 Drawing Figures

HOT AIR RECOVERY SYSTEM FOR A LAUNDRY MANGLE

BACKGROUND OF THE INVENTION

The invention relates to a heated trough mangle, especially a multiple trough mangle for the drying and smoothing of damp pieces of laundry.

Heated trough mangles are already known, in which the steam-air-mixture, formed in the operating zones between the mangle cylinders and the mangle troughs, is suctioned off as exhaust air. For this purpose, the mangle cylinder usually has a perforated mantle surface and a hollow pivot bearing, connected to an outlet arrangement (DE-PS No. 131 918).

This exhaust air contains a considerable amount of unused heat; heat, which otherwise has to be produced continuously by the heating system of the heated trough mangle.

A heated trough mangle is already known, in which at least part of this exhaust air is subsequently used (DE-PS No. 468 074). In this mangle, the outlet pipe connected to the mangle cylinder leads to a duct of a heat exchanger via a fan, with the heat exchanger adapted to transfer heat from one air stream to another. For this, the heat exchanger has a second duct, through which, by means of an additional fan, fresh air is forced, which has been suctioned from the area surrounding the steam trough mangle. The fresh air heated in this manner is then carried to two boxes, arranged in front of and behind the mangle trough and having sievelike perforated places for the exit of the fresh air. The fresh air releases its heat in the zone of these boxes to the laundry passing through, thus pre- or post-drying it.

It is disadvantageous when the heat exchanger is arranged separate from the mangle and at a considerable distance from it. This leads to either large heat losses when conveying the exhaust air from the mangle cylinder to the heat exchanger or considerable cost when isolating the corresponding pipes for heat. The requirement for large space and construction costs are added to this. The warm air flowing into the mangle surroundings, following contact with the laundry to be dried, constitutes an unacceptable stress on the servicing personnel of the heated trough mangle. Furthermore, the considerable amount of heat still contained in the fresh air is thus finally, irrecoverably lost.

DE-OS No. 28 14 618 describes an ironing apparatus, in which the fresh air, having been heated in a heat exchanger by the exhaust air from the mangle cylinders and the condensate produced when heating the mangle troughs, is conveyed to the mangle chamber in the vicinity of a spiral-trough-unit (mangle unit). However, this ironing apparatus has the disadvantage of an external positioning of the heat exchanger with all the already mentioned consequences.

It is common practice to increase the capacity of heated trough mangles by adding additional mangle units, resulting in relatively low cost. This is not possible in the ironing apparatus, according to DE-OS No. 28 14 618.

It is the object of the invention to reduce the energy losses in heated trough mangles, while at the same time avoiding environmental stress.

It is the object of the invention to produce a heated trough mangle, which allows intensive use of the heat contained in the exhaust air, in which the heat recovery system is located inside the heated trough mangle in order to save space, and to which additional mangle units can be added at any time in the future.

SUMMARY OF THE INVENTION

A very important advantage of the heated trough mangle, according to the invention, is that each mangle unit has its own heat exchanger. Thus, the exhaust air from the mangle cylinder flows through the heat exchanger shortly after exiting.

This arrangement, fulfilling the unit construction principle, further allows the supplementing of the heated trough mangle by adding additional mangle units as well as the corresponding heat exchangers.

The exhaust air, flowing through the heat exchanger, is carried into an exhaust air collection channel having only one exhaust air fan, which acts on all mangle units.

In the case of several mangle units (multiple trough mangle), the flow chambers of the heat exchangers, which are provided for the fresh air, are arranged in a continuous fresh air supply channel. By passing through several heat exchangers, the fresh air is thus gradually heated.

The fresh air to be heated is taken from a space, which is formed by outer edges of the heated trough mangle. This is preferably the interior space of a side frame, which already exhibits a higher temperature than the surroundings of the heated trough mangle.

In order to prevent unnecessary contamination of the flow chambers of the heat exchanger, the suction opening of the fresh air supply channel is provided with a filter, which, for example, retains slubs and the like.

The fresh air, transported by the air supply apparatus and heated in the heat exchangers, is carried to a heat providing apparatus, which is located in a virtually sealed mangle chamber together with the mangle cylinders and the mangle troughs. This mangle chamber has only inlet and outlet openings for the pieces of laundry to be ironed. In this way, the mangle chamber is provided with dry, though already heated, fresh air. This has a high drying potential, and does not require additional energy.

The heat providing apparatus is arranged in the first third of the mangle chamber, i.e., in the zone which requires the most heat.

It is of particular advantage if the heat providing apparatus is formed as a nozzle box, which is known in itself from tension drying machines. This can, for example, be arranged in front of the inlet to the first mangle trough, and thus contribute to efficient drying of the laundry pieces. Air in the mangle chamber used for drying laundry pieces is exhausted through the mangle cylinder and is transferred to the heat exchanger for heating fresh air again.

DETAILED DESCRIPTION OF A PREFERRED EMBODIMENT

A heated trough mangle, according to the invention, basically comprises two side frames 1, at least one mangle cylinder 2, which is rotatably positioned in the side frames 1, and at least one mangle trough 3. Mangle cylinder 2 is surrounded around the mantle sides by mangle trough 3 at a center angle of 120° to 180°. Heated trough mangles in which each mangle cylinder 2 has two such mangle troughs 3 are additionally known.

Figure 1:
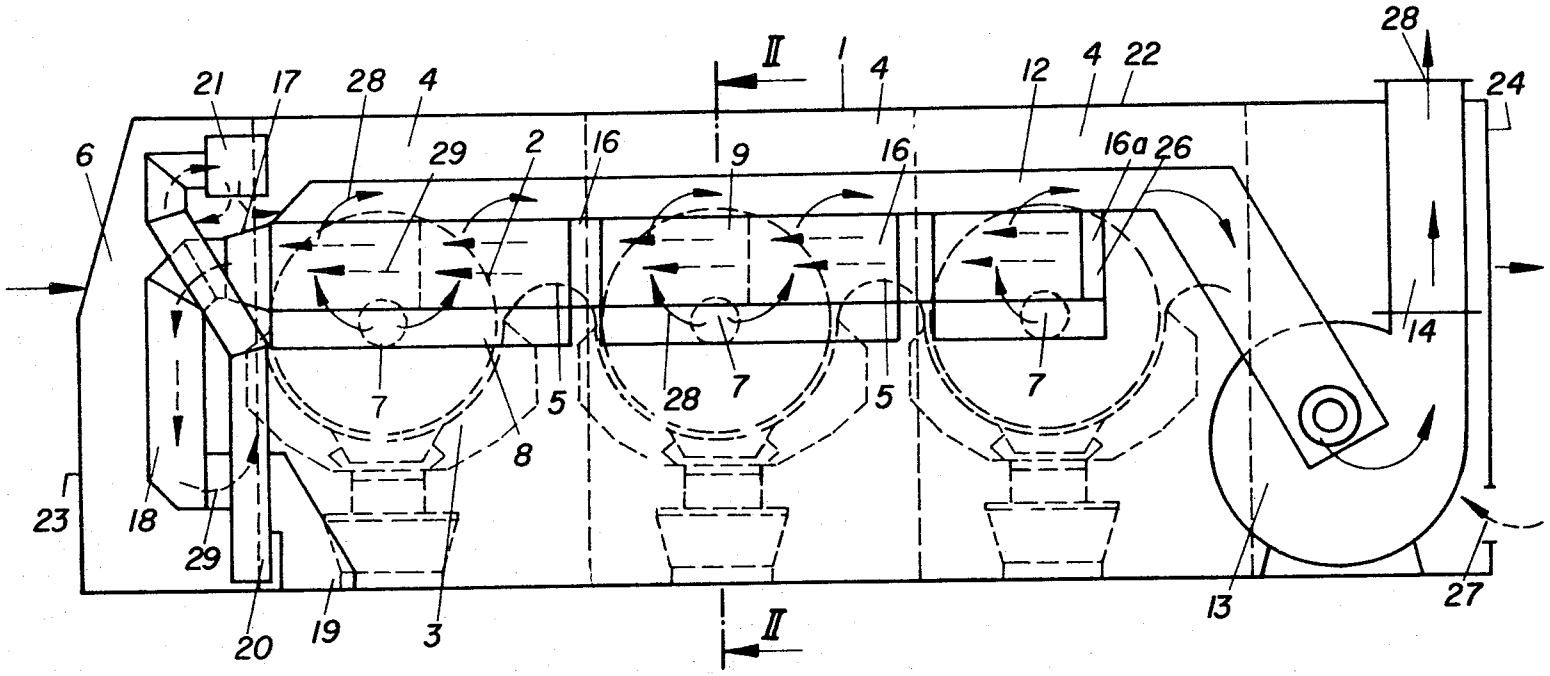
FIG. 1 illustrates a longitudinal cross section through a mantle trough, according to the invention, along section line I—I in FIG. 2.

In the present example, a mangle cylinder 2, a mangle trough 3, portions of side frames 1 which serve as a support, as well as the non-illustrated drive, represent a mangle unit 4. Thus, FIG. 1 illustrates a multiple trough mangle with three successive mangle units 4. Mangle troughs 3 are connected by mangle bridges 5. Although mangle cylinder 2, mangle troughs 3 and mangle bridges 5 are not observable in the chosen sectional plane I—I, these have been indicated in FIG. 1 by dotted lines to demonstrate the construction of the heated trough mangle.

Many troughs 3 as well as trough bridges 5 are heated. For this, they have heating elements, through which, for the most part, a flowable heat carrying medium is conveyed. This can be, for example, steam-air or heat-carrying oil.

The heating elements, as well as the system in the heated trough mangle supplying them with the heat carrying medium, are not depicted in the drawings, since they are not of immediate importance in this connection.

The first mangle unit 4 has a supply unit 6, which is itself already known. Mangle cylinders 2 are hollow cylinders and have a perforated mantle surface. Similarly, the pivot bearing of each mangle cylinder 2 is hollow and forms an exhaust opening 7, which opens into an air mixing box 8.

Figure 2:
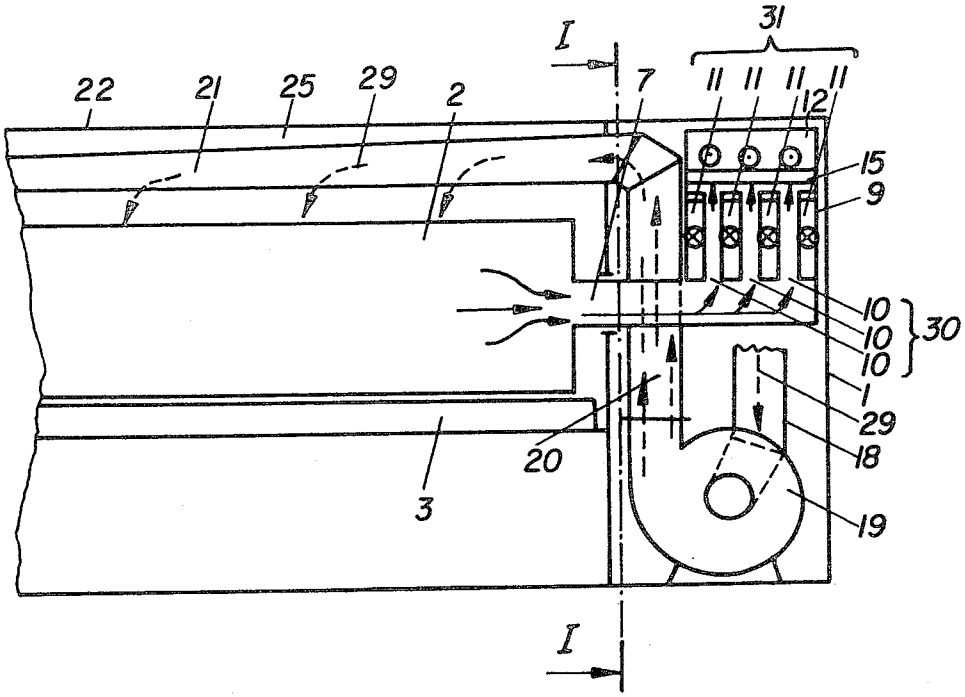
FIG. 2 illustrates a partial cross section along section line II—II in FIG. 1.

Each mangle unit 4 has a heat exchanger 9 with two flow chambers. It is advantageous if the heat exchangers 9 are formed as cross current-plate heat exchangers, so that, as can be seen in FIG. 2, a first flow chamber 30 is formed by a number of slits 10 between the plates of the heat exchanger, and a second flow chamber 31 is formed by a number of slits 11.

It is also possible, according to the invention, to have heat exchanger 9 operate according to the counter-current or co-current principle. Similarly, the heat exchanger surfaces can also be formed differently, for instance as glass tube heat exchangers. It is also advantageous if heat tubes are used.

Heat exchangers 9 can also comprise several heat exchanger components, as shown by a dotted line in FIG. 1.

Slit 10 of each heat exchanger 9 is, on the one hand, connected to exhaust opening 7 of corresponding mangle cylinder 2 through air mixing box 8, and on the other hand, terminates in an exhaust air collection channel 12, which connects all existing mangle units 4 with exhaust fan 13 of the exhaust apparatus. An exhaust air pipe 14, exiting from the mangle apparatus chamber, is attached to the latter.

Each mangle unit 4 additionally has an exhaust air level regulator 15. As shown in FIG. 2, this can be located, for example, between heat exchanger 9 and exhaust air collection channel 12, but may also be located between exhaust opening 7 and air mixing box 8 or elsewhere.

According to the invention, the flow chambers 31 of heat exchanger 9, formed by slits 11, represent a continuous fresh air supply channel 16, which is connected to air supply device 17. In the most simple case of a single trough mangle with only one mangle unit 4, fresh air supply channel 16 is formed by slit 11 of the only existing heat exchanger 9.

A suction device 18 leads from the fresh air supply channel 17 to the fresh air fan 19, while a pressure pipe 20 opens into a conduit device 21. This is preferably formed as a nozzle box, as known from the tension drying machine.

The conduit device 21 is located in the first third of the virtually sealed mangle chamber 25, surrounded by side frames 1, an upper opening 22, the enclosed area formed by the mangle troughs 3 and the mangle bridges 5, as well as a front wall 23 and a rear wall 24.

This first third of the mangle chamber 25 is, according to the requirements of the mangle process, the area which requires the most heat. FIG. 1 illustrates that the conduit device 21 is arranged immediately in front of the first mangle unit 4.

The conduit device 21 can also be arranged at the end of the first mangle unit 4 and the first trough bridge 5. The suction opening 16*a* of the fresh air supply channel 16 is located inside the outer edge of the steam trough mangle, according to the invention, preferably inside the side frames 1 containing the heat exchanger 9, the air mixing box 8 and the exhaust air collection channel 12.

The suction opening preferably has a filter 26, which, above all, stops slubs and the like.

Rear wall 24 finally contains an opening 27 in the vicinity of exhaust air fan 13, which allows the intake of air from the surroundings of the heated trough mangle inside the side frames 1.

In conclusion, the special features of the invention comprise the entire previously described heat recovery system, including the exhaust and the air supply devices being located inside the outer edges of the heated trough mangle, thus eliminating additional arrangements outside the heated trough mangle for the purpose of heat recovery.

The heated trough mangle, according to the invention, operates as follows:

The pieces of laundry to be ironed are fed into supply unit 6 and successively passed through mangle units 4 of the heated trough mangle.

As a result of the contact of the pieces of laundry with the heated mangle troughs 3, the water they contain evaporates. The steam enters the interior space of mangle cylinder 2 through its perforations and together with the air flowing in through the open upper side of mangle cylinder 2 forms a steam-air-mixture: exhaust air 28. Through exhaust openings 7, exhaust air 28 (depicted by solid lines) enters the air mixing box 8 and then slit 10 of heat exchanger 9. It finally reaches the exhaust air collection channel 12 and exits from the heated trough mangle through exhaust air fan 13 and exhaust air pipe 14.

Corresponding to the practical operating conditions, the amount of exhaust air 28 to be transported out of the mangle cylinders 2, is individually influenced by exhaust air level regulator 15 for each mangle unit 4.

Under the influence of fresh air fan 19 of the air supply device 17, fresh air 29 (depicted by dotted arrows) is carried from the interior space of the side frames 1 through filter 26 into the fresh air supply channel 16. It is replaced by air from the surroundings of the heated trough mangle, which enters the side frames 1 via opening 27 and thus effectively cools the drive of the exhaust air fan 13.

Fresh air 29 enters into an intensive, gradual heat transfer process with exhaust air 28 when flowing through fresh air supply channel 16, and is then heated. Exhaust air 28 here releases a considerable amount of the heat which it contains, which would otherwise be wasted, to fresh air 29. Trough sliding means, separated from exhaust air 28, such as for instance silicon oil, collect in the air mixing boxes 8 and can be removed from these in simple fashion.

The heated fresh air 29 enters the mangle chamber 25 from the conduit device 21. There, it comes into contact with the damp and cold pieces of laundry, entering the first mangle unit 4, and effects an acceleration of the drying process by preheating these pieces of laundry. The blowing of the heated fresh air 29 into the mangle chamber 25 achieves drying of the laundry pieces and conserves a considerable amount of energy, which otherwise would have been exhausted.

I claim:

1. In a heated trough mangle comprising a frame, at least one mangle unit located inside the frame and including a mangle cylinder with a perforated mangle surface and at least one heated mangle trough partially surrounding the mangle cylinder, an exhaust device with an exhaust air channel to withdraw exhaust air from inside the mangle cylinder to outside through the exhaust air channel, an air supply device to supply fresh air and having an air providing device, and an apparatus to transfer the heat from one air stream into another air stream, the improvement comprising: the frame including a sealed mangle chamber, each mangle unit having a heat exchanger with first and second flow chambers, the first flow chamber of the heat exchanger being connected at one end to the mangle cylinder and connected at the other end to the exhaust device through the exhaust air channel, the second flow chamber of the heat exchanger being connected to the air supply device and forming a continuous fresh air supply channel, the air providing device of the air supply device terminating adjacent to the mangle cylinder so that the fresh air is continuously heated and supplied to the mangle unit to dry laundry pieces.

2. A heated trough mangle according to claim 1, in which each heat exchanger of the mangle unit has an individual exhaust air level regulation device.

3. A heated trough mangle according to claim 1, in which the air providing device is located in the first third of the mangle chamber.

4. A heated trough mangle according to claim 1, in which the mangle unit further includes a trough bridge, and the air providing device is located above the trough bridge.

5. A heated trough mangle according to claim 1, in which the air providing device is formed as nozzle boxes.

6. A heated trough mangle according to claim 1, in which the fresh air supply channel includes a suction opening located inside the outer edges of the heated trough mangle.

7. A heated trough mangle accroding to claim 6, in which the suction opening of the fresh air supply channel has a filter.

8. A heated trough mangle according to claim 6, in which the exhaust device includes an exhaust air fan, and the frame includes an air opening, the exhaust air fan being located between the suction opening of the fresh air supply channel and the inlet opening.

* * * * *